US005355814A

United States Patent [19]

Kemori et al.

[11] Patent Number: 5,355,814

[45] Date of Patent: Oct. 18, 1994

[54] GASIFIER BURNER FOR POWDERED SOLID FUELS AND METHOD FOR USING THE SAME

[75] Inventors: Nobumasa Kemori; Kimiaki Utsunomiya; Hitoshi Takano, all of Niihama; Keiji Fujita, Saijou, all of Japan

[73] Assignee: Sumitomo Metal Mining Company Limited, Tokyo, Japan

[21] Appl. No.: 8,818

[22] Filed: Jan. 25, 1993

[30] Foreign Application Priority Data

Jan. 24, 1992 [JP] Japan ..... 4-032804

[51] Int. Cl.[5] ..... F23D 1/06

[52] U.S. Cl. ..... 110/265; 110/347; 431/181; 431/353

[58] Field of Search ..... 110/263, 265, 264, 347; 431/9, 160, 181, 187, 284, 285, 350, 353

[56] References Cited

U.S. PATENT DOCUMENTS

| | | | |
|---|---|---|---|
| 3,273,621 | 9/1966 | Childree | 431/284 |
| 4,566,393 | 1/1986 | Connell et al. | 110/261 |
| 4,741,279 | 5/1988 | Azuhata et al. | 110/347 |

FOREIGN PATENT DOCUMENTS

| | | | |
|---|---|---|---|
| 4100596 | 7/1992 | Fed. Rep. of Germany | 110/263 |
| 61-28004 | 6/1986 | Japan . | |
| 62-80234 | 4/1987 | Japan . | |
| 1-129933 | 5/1989 | Japan . | |
| 2074306 | 10/1981 | United Kingdom | 110/264 |
| 2094972 | 9/1982 | United Kingdom | 110/265 |
| 2099132 | 12/1982 | United Kingdom . | |
| 2162303 | 1/1986 | United Kingdom . | |

*Primary Examiner*—John M Sollecito
*Assistant Examiner*—William C. Doerrler
*Attorney, Agent, or Firm*—Foley & Lardner

[57] ABSTRACT

The gasification burner of this invention capable of maintaining a high combustion rate for a long period of time comprises a combustion chamber having a ceiling with a small hole in its center, a pre-mixing pipe fitted into the small hole and having a nozzle at its top, wherein the pre-mixing pipe and the combustion chamber are concentric, and the spread angle of the gas flow sprayed from the end of the pre-mixing pipe is between 10 and 40 degrees, so that the relationship between the bottom of the combustion chamber and the conical gas flow is regulated by keeping a good balance between the gasification rate of the powdered coke and the life of the combustion chamber.

8 Claims, 7 Drawing Sheets

GASIFIER BURNER FOR POWDERED SOLID FUELS AND METHOD FOR USING THE SAME

BACKGROUND OF THE INVENTION

1. Field of the Invention

This invention relates to a reduction smelter or smelting furnace for iron and non-iron metals, and more particularly to a gasification burner for powdered solid fuel which serves as the source of reducing gas and heat for a zinc reduction smelter or smelting furnace.

2. Description of the Prior Art

In the most common Imperial Smelting Process (ISP) method of pyrometallurgical zinc smelting, zinc sulfide concentrate is roasted, and the lump sinter obtained through roasting is put into the smelting furnace together with the lump coke. The zinc is evaporated out, so that a reducing gas containing the zinc vapor is obtained. The zinc vapor in this gas is absorbed by a lead splash condenser, and recovered to obtain crude zinc.

In comparison to other pyrometallurgical smelting methods, this ISP method has an advantage that lead and zinc can be processed at the same time, thus being very cost competitive.

However, recently due to very intense cost competition, the cost competitiveness of this ISP method is very inefficient. The reason is the high cost of using lump coke.

On the other hand, in countries like Japan where the cost of electricity is high, hydrometallurgical smelting is also unfavorable.

Therefore, in order to improve the cost competiveness of the ISP method many improvements to the pyrometallurgical method of smelting have been proposed and researched.

One of the most promising of these proposals has been disclosed in Japanese Patent Publication No. Showa 61-28004, "Injection Smelting of Zinc Calcine". In this method, slag which has a $Fe/SiO_2$ ratio close to that of the zinc concentrate, and a crude lead metal, are contained beforehand in the furnace, and the roasted powdered zinc concentrate, a reducing agent, and highly oxygenenriched air are blown through a lance into the melt bath. Powdered coke and/or fine carbon material is used as the reducing agent. When compared to the ISP method, because powdered coke and/or fine carbon material is used in the place of lump coke, it is possible to greatly reduce the operating expenses.

However, in this method, because the retention time of the powdered coke in the furnace is very short, the effective utilization of the powdered coke, or in other words, the gasification rate of how much of the carbon burns and gasifies to gas, is much worse than the ISP method regardless of how small the grain diameter of the powdered coke is compared to lump coke. As a result, a large amount of the unburned powdered coke is scattered on the post-process condenser, hindering condensation of the zinc. Therefore the rate of recovery for zinc is made lower.

Two inventions have been proposed to do away with this problem. They are disclosed in Japanese Patent First Publications No. Sho 62-80234 and No. Hei 1-129933. These two inventions are both related to the blowing-in lance method.

The invention described in Japanese Patent First Publication No. Sho 62-80234 uses a double pipe construction for the lance having outer and inner pipes. Fine coke is supplied through the inner pipe, and oxygen-bearing gas such as oxygen per se or oxygen-enriched air is supplied through the outer pipe, and the fine coke and the oxygen-bearing gas are mixed in the mixing section on the tip of the lance.

The invention described in Japanese Patent First Publication No. Hei 1-129933 uses a zinc calcine supply nozzle located in the center, and several supply nozzles for mixing and discharging the fine coke and oxygen-bearing gas located around the central zinc calcine supply nozzle.

Both of these inventions are characterized by the mixing section being located in the narrow portion of the nozzle tip section where the fine coke and oxygen-bearing gas are mixed, and then after mixing, the mixture is discharged into the furnace from the nozzle outlet port at nearly the speed of sound.

Use of the lance as described in both of the aforementioned inventions improves the gasification rate of the fine coke a degree. However as time elapses, they both experience a rapid decline in the gasification rate, and also the zinc recovery rate declines very rapidly. The reason for this is that the discharge velocity is so high, that the tip of the burner is quickly worn away by the fine coke, and thus the mixture condition of fine coke and oxygen-bearing gas becomes poor causing a decrease in gasification rate and combustibility.

Also, the fine coke which is blown using a lance as in these two inventions, is gasified in an oxygen-poor state inside the furnace. Because the furnace temperature is kept below 1500° C. in order to protect the bricks of the furnace, there is a limit to how far the gasification rate of the fine coke can be improved, regardless of how well the fine coke and oxygen-bearing gas are mixed, for the following reason.

As is well known, in an oxygen-poor state, carbon, which is the main component of the fine coke, is gasified according to the following equations.

$$C(s)+O_2(g)=CO_2(g) \quad \text{Eq. 6}$$

$$C(s)+CO_2(g)=2CO(g) \quad \text{Eq. 7}$$

In other words, oxygen first reacts with carbon, as shown in Equation 6, to form $CO_2$ depending on the amount of oxygen. Next, this $CO_2$ reacts with the remaining carbon, as shown in the Equation 7, to form CO. As is well known, the reaction of Equation 6 is an exothermic reaction which advances very quickly. However the reaction of Equation 7 is an endothermic reaction, and its rate of reaction has a positive correlation with temperature. At temperatures around 1500° C., the rate of reaction of Equation 7 is comparatively slow, and in order to convert all of the remaining carbon into CO, the carbon must remain in the furnace for a long time. However, when the two inventions mentioned above are used, the period of time that the carbon remains in the furnace cannot be lengthened.

SUMMARY OF THE INVENTION

The objective of this invention is to provide a gasifier burner for solid fuel which can maintain a high rate of gasification for a long period of time.

In order to solve the aforementioned problems, a gasification burner is provided to comprise a combustion chamber and a pre-mixing pipe in specific dimensions so that a space is utilized for reaction near the discharge port of the pre-mixing pipe around the conical gas flow into the combustion chamber from the pre-mixing pipe.

DESCRIPTION OF THE PREFERRED EMBODIMENTS

Figure 1:
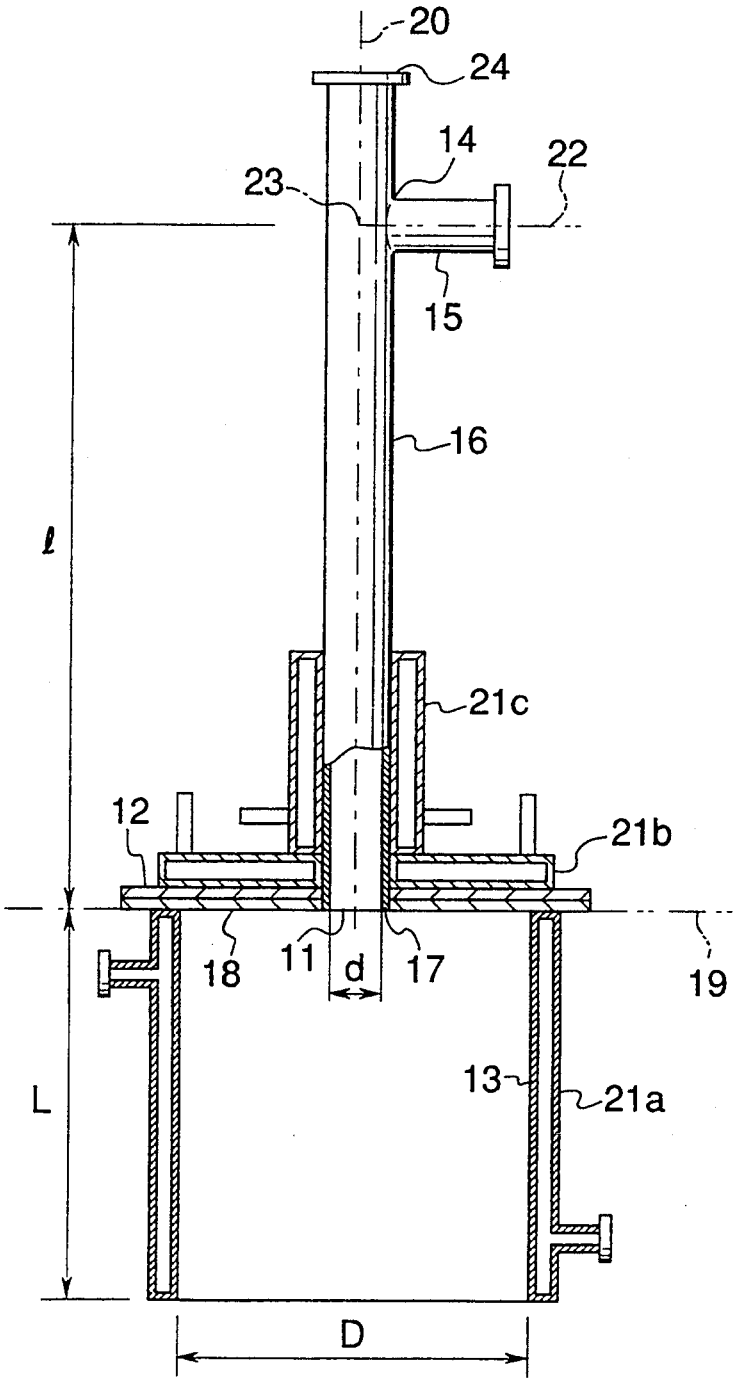
FIG. 1 is a partial cross-sectional view of the gasification burner of a first embodiment of the invention.

In a first embodiment of this invention, a gasifier burner comprises a combustion chamber having a ceiling with a hole formed in its center, and a pre-mixing pipe having a nozzle laterally located at the top end section of the pre-mixing pipe and aligned at its lower end section with the hole in the ceiling of the aforementioned combustion chamber. The pre-mixing pipe and combustion chamber are concentric, and the horizontal plane formed by the bottom end face of the pre-mixing pipe and the lower surface of the chamber ceiling substantially forms right angles with the center axis of the pre-mixing pipe. The inside diameter of the pre-mixing pipe is d mm, the distance from the point where the center axes of the nozzle and the pre-mixing pipe cross each other, to the bottom end of the pre-mixing pipe is 1(el)mm, and the inside diameter of the combustion chamber is D mm and the length is L mm, where $1(el) \geqq 5d$, and the angle $\alpha$ found by Equation 8 below is 5 degrees to 20 degrees. It is even more desirable if A, found by Equation 9 below, is between 0 mm to 100 mm. It is also desirable to install a water-cooled jacket in at least one of the combustion chamber and the pre-mixing pipe.

$$\tan \alpha = (D-d)/2/L \qquad \text{Eq. 8}$$

$$\tan 12 \text{ degrees} = \{(D-d)/2\text{-}A\}/L \qquad \text{Eq. 9}$$

In a second embodiment of this invention, sub-mixing pipes are located on the ceiling of the combustion chamber of the gasification burner for powdered solid fuel of the first embodiment of this invention. It is desirable that several sub-mixing pipes are equally spaced around the pre-mixing pipe, between the outer periphery of the combustion chamber and the pre-mixing pipe, so that they form a concentric circle with the pre-mixing pipe.

Another feature of this invention relates to a method of using the gasification burner for powdered solid fuel of the second embodiment, and an oxygen-bearing gas such as oxygen per se, air or oxygen-enriched air and is characterized by making the value of the oxygen ratio m in the pre-mixing pipe obtained from Equation 10, greater than the oxygen ratio m in the sub-mixing pipes obtained from Equation 10. It is desirable that the oxygen ratio m in the pre-mixing pipe is between 0.9 and 1.0. Also, it is desirable to supply most of the oxygen-bearing gas to the pre-mixing pipe, and to supply powdered solid fuel to the pre-mixing pipe so that the oxygen ratio in the pre-mixing pipe is between 0.9 and 1.0 with the remaining oxygen-bearing gas and powdered solid fuel supplied to the sub-mixing pipes.

m=(Amount of oxygen actually supplied)/(Amount of oxygen required to oxidize all of the C and H in the fuel to obtain $CO_2$ and $H_2O$) Eq. 10

Generally, when a blow pipe is used to discharge gas into the furnace, the blown gas forms a cone-shaped gas flow. The space near the blow pipe above the conical surface of the gas flow is not used for reaction and does not help the reaction in any way. However, by placing a cylindrical hood over this cone-shaped flow, it is possible to cause the gas to be recirculated in the space surrounded by the hood and the conical surface formed by the gas flow. Therefore, it is possible to extend the period of time that the gas actually remains in the furnace. The invention utilizes this mechanism.

The preferred embodiments of this invention will be explained below with reference to the drawings.

FIG. 1 is of the gasification burner of a first embodiment of this invention. This gasification burner comprises a combustion chamber 13 in which a hole 11 is formed in the center of the chamber ceiling 12, and a pre-mixing pipe 16 which fits into the hole 11 in the chamber ceiling 12 and has a nozzle 15 located at the top section 14 thereof. The pre-mixing pipe 16 and the combustion chamber 13 are arranged concentric, and the horizontal plane 19 including the bottom end 17 of the pre-mixing pipe 16 and the lower surface 18 of the chamber ceiling 12 forms substantially right angles with the center axis 20 of the pre-mixing pipe 16.

Water-cooled jackets 21*a*, 21*b* and 21*c* are located in the combustion chamber 13, and in the bottom section of the chamber ceiling 12 and the pre-mixing pipe 16 respectively. The internal diameter d of the pre-mixing pipe 16 is 100 mm, the distance 1(el) from the point where the center axis 22 of the nozzle 15 at the top section 14 of the pre-mixing pipe crosses the center axis 20 of the pre-mixing pipe 16 to the bottom end 17 of the pre-mixing pipe 16 is 1000 mm, the internal diameter D of the combustion chamber 13 is 500 mm, and the length L is 600 mm. Also, the angle $\alpha$, found using the aforementioned equation 8, is 18.4 degrees, and the value of A, found from Equation 9, is 70 mm. The value A of Equation 9 is a parameter to indicate the interval between the conical surface of the gas flow and the side wall of the combustion chamber 13 at its lower end.

Figure 2:
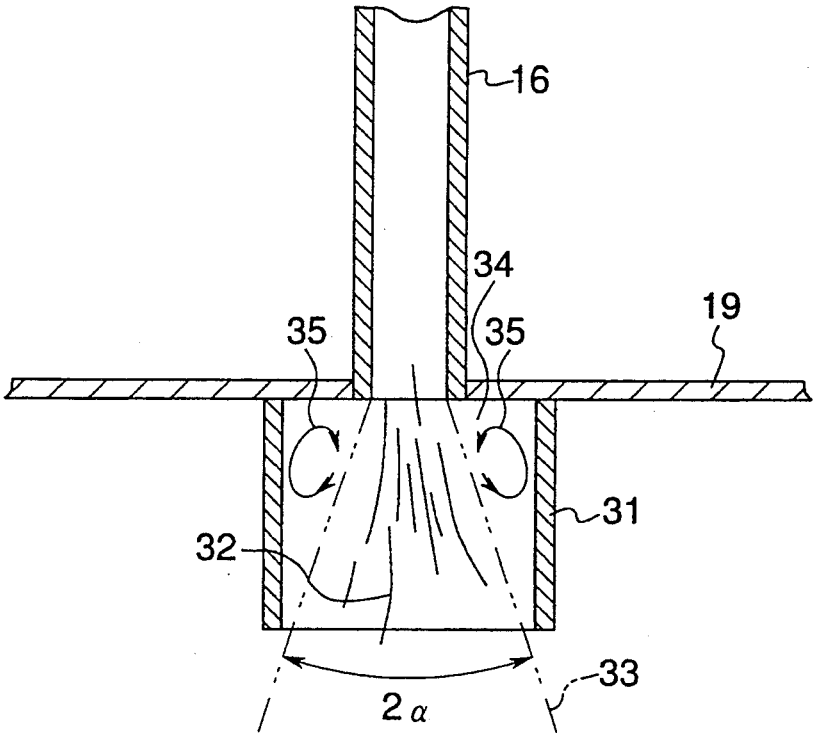
FIG. 2 is a drawing showing the relationship between the cone shaped gas flow, created by blowing gas from the blow pipe, and the cylindrical shaped hood.

When the aforementioned gasification burner is used, cooling water flows through the water-cooled jackets 21*a*, 21*b* and 21*c*, and air for carrier is used to blow the powdered solid fuel into the pre-mixing pipe 16 from the top end 24 of the pipe 16, and industrial oxygen as an oxygen-bearing gas is blown from the nozzle 15. As shown in FIG. 2, recirculation flows 35 of the combustion gas are formed inside the combustion chamber 13.

In other words, generally when a blow pipe is used to discharge gas into the furnace, the gas flow of the blown gas forms a conical shape as indicated by numeral 32 in FIG. 2. The space near the blow pipe above the conical surface 33 of the gas flow 32 is a dead zone and in no way helps the reaction as shown in FIG. 2. However, by placing a cylindrical hood 31 around this conical gas flow 32, it is possible to create recirculation flows 35 in the space 34 surrounded by the hood 31 and the conical surface 33 of the gas flow 32, so that it is possible to extend the residence time of the gas actually in the combustion chamber.

In the gasification burner of this first embodiment of the invention, when the speed of the gas inside the pre-mixing pipe 16 is slow, recirculation of the combustion gas as shown in FIG. 2 cannot be formed inside the combustion chamber 13. However, this is actually not a concern because, in order to maintain an excellent mixture of powdered solid fuel such as powdered coke or fine carbon material and oxygen-bearing gas, it is necessary that the gas speed inside the pre-mixing pipe is at least 5 m/sec or more, and as long as this condition is satisfied, the recirculation flows mentioned above will positively occur.

When the powdered solid fuel and oxygen-bearing gas are discharged or sprayed from the pre-mixing pipe 16, the spread angles of the powdered fuel and oxygen-bearing gas are nearly the same near the end of the pre-mixing pipe 16, and that angle varies normally between 10 and 40 degrees according to the discharge speed. When coke is used as the powdered solid fuel, in order that abrasion of the inside surface of the pre-mixing pipe due to the coke does not cause a problem, the maximum gas speed must be kept to approximately up to 10 m/sec, and in this case the spread angle is 24 degrees.

The strength of the aforementioned recirculation flow and the life of the combustion chamber is determined by the relationship between the surface of the conical gas flow, having a spread angle $2\alpha$, and the position of the lower end of the combustion chamber. In other words, the recirculation flow becomes stronger as the lower end of the combustion chamber is shifted more into the conical shaped flow, and the life of the combustion chamber is shortened. Also, the recirculation flow quickly weakens as the lower end of the combustion chamber is separated from the conical gas flow, and the life of the combustion chamber is lengthened.

In this first embodiment of the invention, the inside diameter of the pre-mixing pipe is taken to be d mm, the internal diameter of the combustion chamber is taken to be D mm and the length is L mm, and the spread angle is taken to be $2\alpha$. The values d, D, and L are selected to satisfy Equation 8 above with the angle $\alpha$ between 5 and 20 degrees, because the gasification burner made using these values has good gasification rate of the powdered solid fuel and good combustion chamber durability.

The maximum gas speed that can be used so that abrasion inside the pre-mixing pipe does not become a problem depends on the type of powdered solid fuel and the quality of the pre-mixing pipe. For example, if powdered coke is used as the powdered solid fuel, the gas speed is approximately 10 m/sec and in this case the spread angle is 24 degrees. In this case, if d, D, and L are selected using Equation 9 above so that the value A is between 0 and 100 mm, it is even more effective in increasing the life of the combustion chamber.

The dimension d, D, and L are determined as described below.

First, the total volume of the air for carrying powdered solid fuel and the oxygen-bearing gas is taken to be W, the flow speed V of the gas is selected so that there is no abrasion caused inside the pre-mixing pipe, and d is found from the Equation $W/V=d^2/4\pi(nm)$. Next, using Equation 6 and Equation 7, the amount of oxygen-bearing gas W' produced and the temperature T (absolute temperature) of the oxygen-bearing gas are estimated, and using t as the desired time that the gas remains in the combustion chamber, the relationship given in Equation 11 is obtained.

$$D^2L/4\pi = W'Tt/273 \qquad \text{Eq. 11}$$

Then D and L are determined using Equations 8 and 11 and the value d, so that the angle $\alpha$ of Equation 8 is between 5 and 20 degrees.

Next, using the obtained values of D and L, using Equation 9, D and L are selected so that the A value is between 0 and 100 mm.

Normally the temperature T is between 2470 K and 2770 K. Therefore, it is necessary to install water-cooled jackets in at least the combustion chamber and on the chamber ceiling. Also, if highly oxygen-enriched air is used as the oxygen-bearing gas, it is possible that the combustion reaction may occur in the lower section of the pre-mixing pipe. In this case, it is best if there is also a water-cooled jacket in the lower section of the pre-mixing pipe.

Mixing the powdered solid fuel and the oxygen bearing gas inside the pre-mixing pipe is a large factor for increasing the gasification rate. There are two methods which can be used to accomplish this objective. The first method is to increase the gas speed. The other method is to lengthen the residence time of the fuel and gas in the pre-mixing pipe.

Since increasing the gas speed remarkably shortens the life of the pre-mixing pipe, there are limits as to how far this method can be used. Therefore, in this invention, a good mixture of powdered solid fuel and oxygen-bearing gas is maintained inside the pre-mixing pipe by the following process. Specifically, the time the oxygen-bearing gas and the powdered solid fuel are in the pre-mixing pipe is maintained sufficiently by keeping $1(el) \geqq 5d$ where the distance 1(el) mm is from the point where the center axes of the pre-mixing pipe and the nozzle cross each other, to the bottom end of the pre-mixing pipe.

In this embodiment of the invention, as long as the condition of $1(el) \geqq 5d$ is satisfied, in other words, 5d is equal to or less than 1(el), it is possible to have uniform gas speed, gas flow density, and a uniform distribution of powdered solid fuel at every lateral cross-section in the pre-mixing pipe. Therefore, the center of the gas flow blown into the combustion chamber coincides with the center of the combustion chamber and there is no shifting, and so there is no localized wear to the walls of the combustion chamber due to the attack of the produced reaction gas being off-centered or drifted.

Next a second embodiment of this invention will be described.

Figure 3:
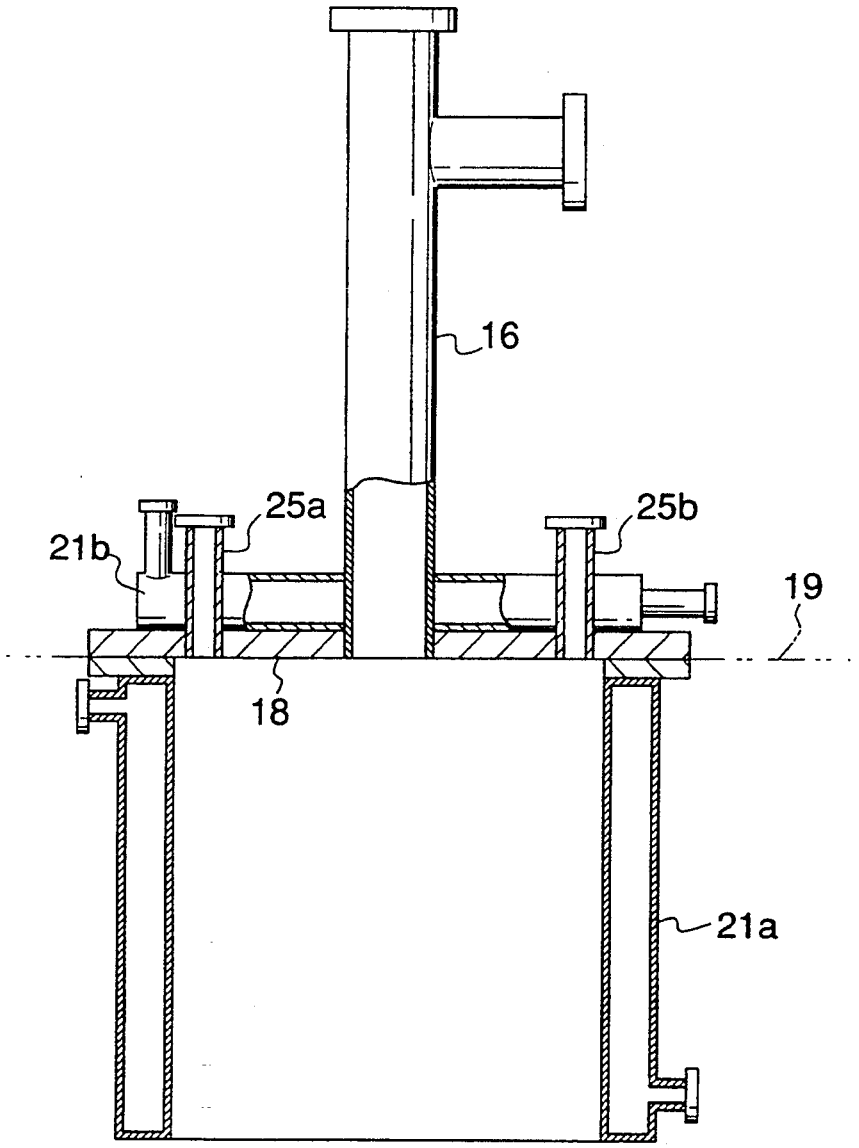
FIG. 3 is a partial cross-sectional view of one example of the gasification burner of a second embodiment of the invention.
Figure 4:
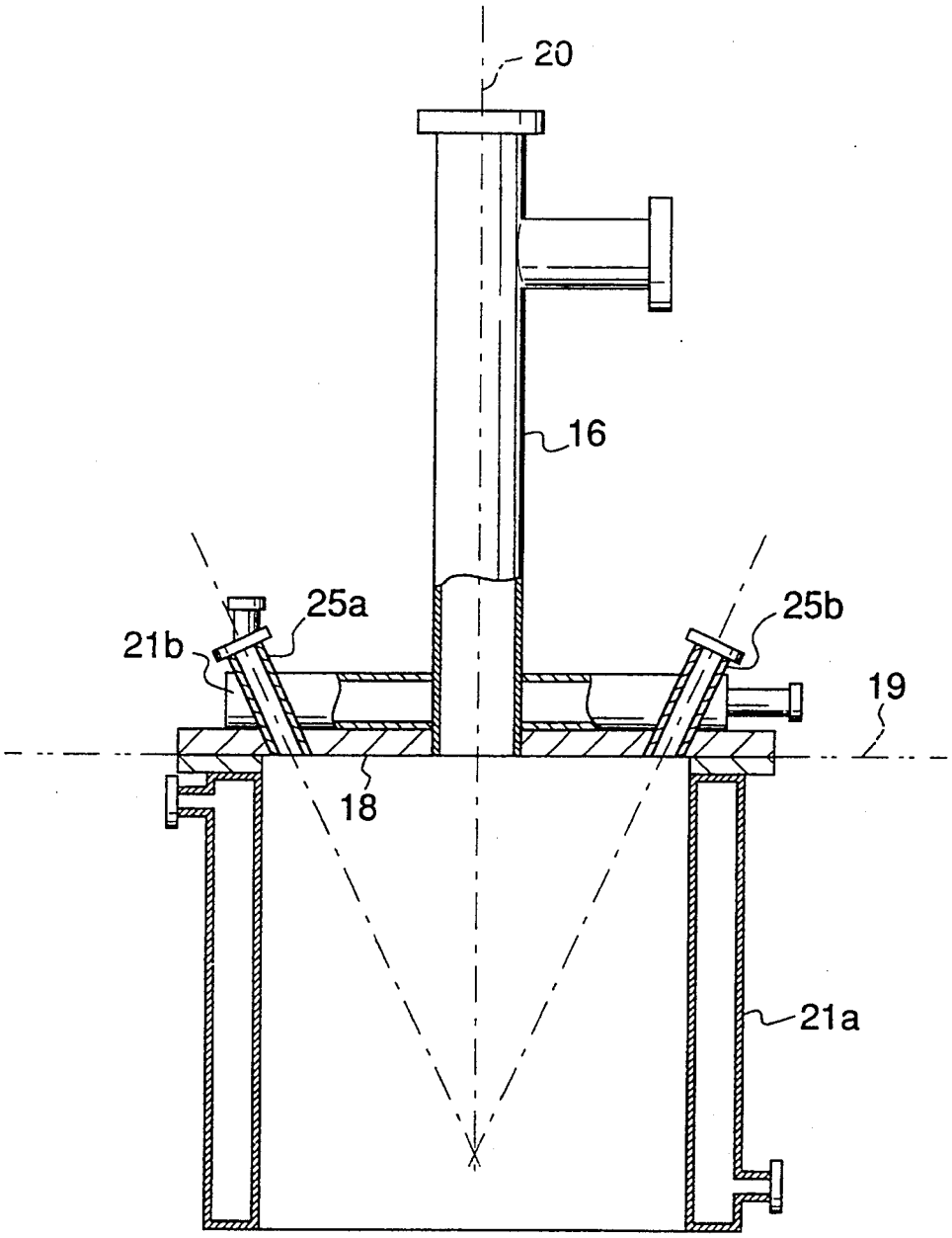
FIG. 4 is a partial cross-sectional drawing of another example of the gasification burner of the second embodiment of the invention.

FIGS. 3 and 4 both show a second embodiment of the invention. Both FIGS. 3 and 4 are cross-sectional views of a gasification burner that further comprises two sub-mixing pipes **25*a* and 25*b*, located in the ceiling 12 of the combustion chamber of the gasification burner, and located around the pre-mixing pipe 16 forming a concentric circle with the pre-mixing pipe 16**.

In FIG. 3, the blow directions of the sub-mixing pipes **25*a* and 25*b* are faced substantially in the same direction as, in other words parallel to the blow direction of pre-mixing pipe 16. In FIG. 4, the blow directions of the sub-mixing pipes 25***a* and 25*b* are faced in toward the center axis 20 of the blow direction of the pre-mixing pipe 16.

The provision of these sub-mixing pipes in this second embodiment of the invention is to further improve utilization of the unused space or dead zone by the recirculation flow which has occurred in the first embodiment. In other words, in the first embodiment of the invention, the strength of the recirculation flow relies mainly on dimensions of the pre-mixing pipe and the combustion chamber and on the discharge velocity from the premixing pipe etc., and so it is difficult to constantly maintain the optimum state due to changes in operating conditions.

In this second embodiment of the invention, the purpose of the sub-mixing pipes is to remove this problem, and by blowing powdered solid fuel alone or powdered solid fuel and oxygenbearing gas into the recirculation flow, it is possible to more efficiently utilize the unused space or dead zone, together with the effects of the recirculation flow.

The reason that the sub-mixing pipes are located in the combustion chamber ceiling is that if they were located in a side wall of the combustion chamber, the cone shaped gas flow formed from the pre-mixing pipe would be greatly broken up, greatly reducing the strength of the recirculation flow.

The location and the number of sub-mixing pipes installed in the chamber ceiling is not especially fixed, however, they should be used to decrease as much as possible the amount of unused space or dead zone without causing wear and abrasion to the side wall of the combustion chamber. They must not break up the conical gas flow formed by the pre-mixing pipe, and therefore it is best if several sub-mixing pipes are located at equal intervals around the pre-mixing pipe forming a concentric circle with the pre-mixing pipe.

Next the method of using the gasifier burner of this invention will be explained.

Figure 5:
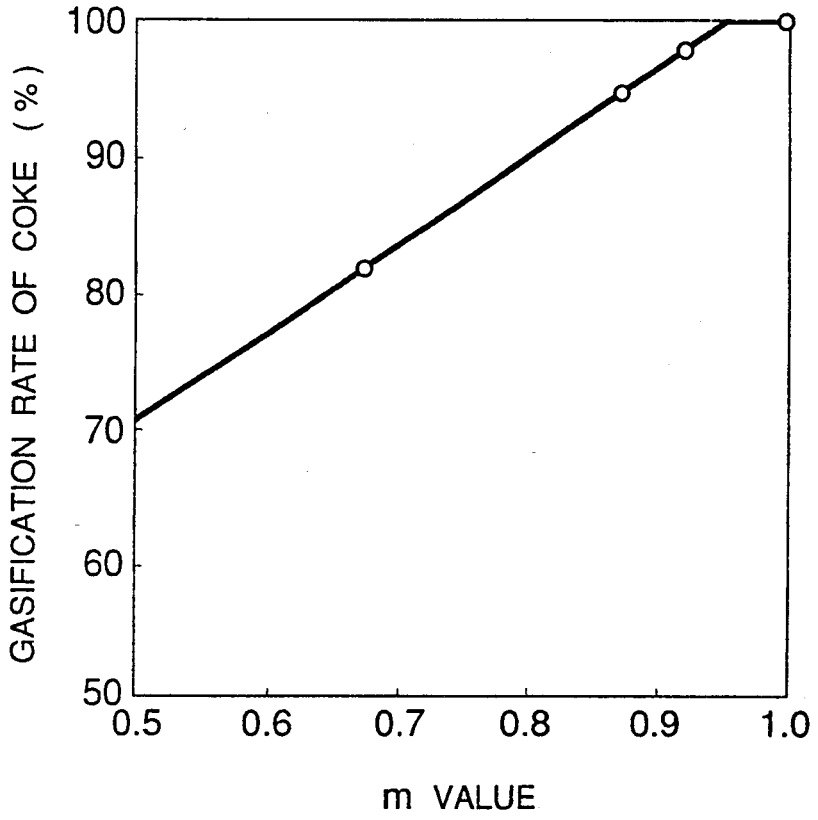
FIG. 5 is a graph showing the relationship between the measured m value and the gasification rate of the powdered coke when the gasification burner of the first embodiment of the invention is used.

FIG. 5 is a graph showing the relationship between the values of m measured for the gasification burner of the first embodiment and the gasification rate of powdered coke, where the axis of abscissa represents the m value, and the axis of ordinate does the gasification rate of the powdered coke.

Figure 6:
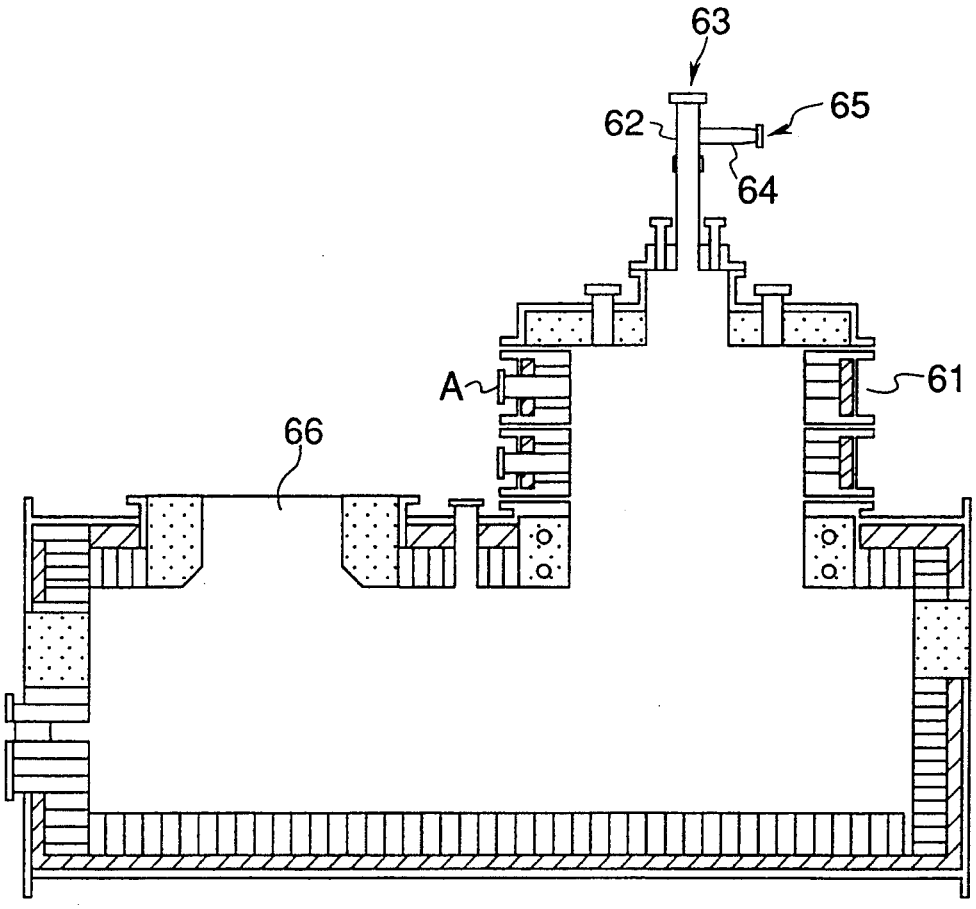
FIG. 6 is a cross-sectional drawing of the smelting furnace having a gasification burner, used for finding the relationship shown in FIG. 5.

This graph was obtained through the following steps; mounting the gasification burner, described in the first embodiment of this invention, at the top of the reaction shaft 61 of the furnace, as shown in FIG. 6, feeding 120 kg/h of powdered coke (with a 82% C grade) to the pre-mixing pipe 62 of the burner through the top end 63 using air at 55 $Nm^3/h$, supplying a predetermined amount of industrial oxygen (with a concentration of 90%) through the end 65 of the nozzle 64 located at the upper side portion of the pre-mixing pipe 62, measuring the $CO_2$, CO, and $O_2$ concentrations in the exhaust gas using the measurement holes (not shown in the figure) located in the uptake section 66, and then estimating the gasification rate of the powdered coke from the results of the measurement.

As can be seen in FIG. 5, as the m value increases, the gasification rate also increases, and at an m value of 0.95, the gasification rate is 100%. The m value required for making the gasification rate 100% changes a little depending on the amount of coke fed and the rate of oxygen enrichment air for combustion in the oxygen-bearing gas, however for all cases it was found to be less than 1.0.

Figure 7:
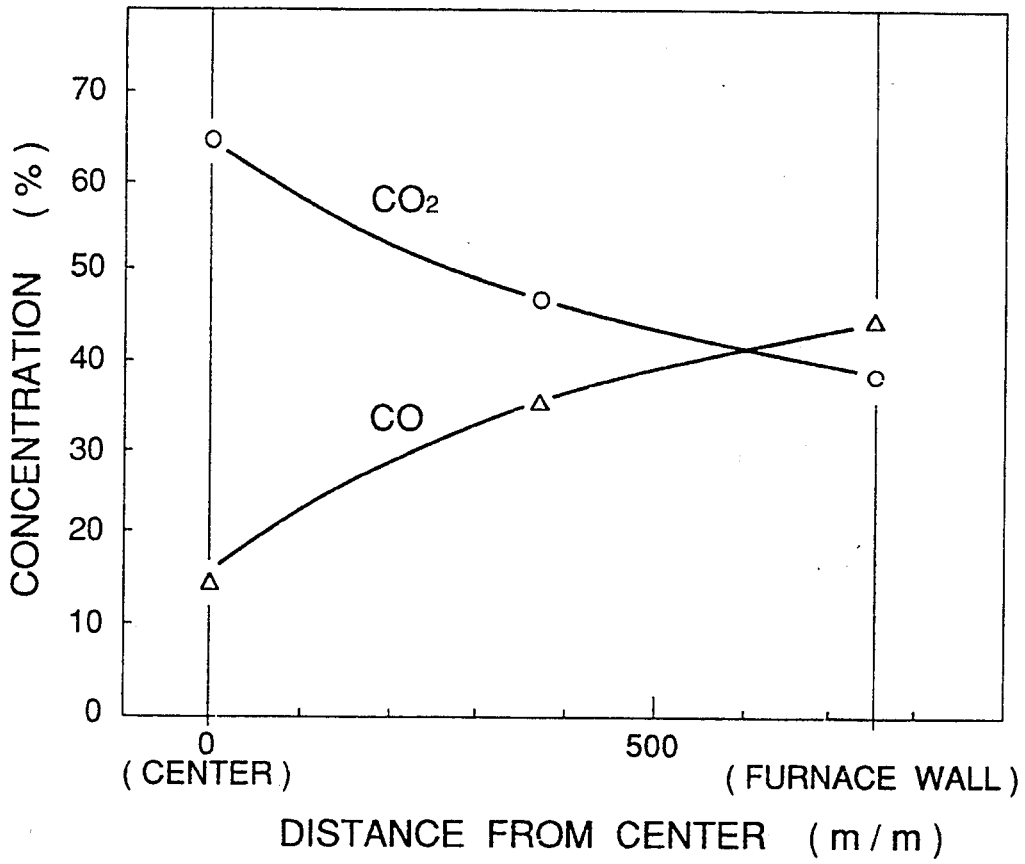
FIG. 7 is a graph showing the concentration distribution of $CO_2$ and CO in the radial direction between the center and wall of the reaction tower, obtained in the examples of the first embodiment of this invention.

Next, using the device shown in FIG. 6, 240 kg/h of powdered coke (with a 82% C grade) was fed into the pre-mixing pipe 62 through the top end 63 using air at 55 $Nm^3/h$, and 280 $Nm^3/h$ of industrial oxygen (with a concentration of 90%) was supplied from the nozzle 64 located on the side of the upper portion of the pre-mixing pipe, and then the fuel and oxygen-bearing gas were gasified. A water-cooled sampler (not shown in the figure) was inserted through the measurement hole A located in the reaction shaft 61 and the concentrations of $CO_2$ and CO were analyzed at a prescribed location in the reaction shaft 61, and the amount of unburned powdered coke which accumulated on the sampler was measured. The concentration distribution of $CO_2$ and CO in the radius direction from the center of the reaction shaft 61 to the side wall (furnace wall) of the reaction shaft 61 is shown in FIG. 7. According to the distribution of unburned powdered coke, the amount of unburned powdered coke was found to be large in the range from the center of the reaction shaft to a point 360 mm from the center in the direction of the side wall, however, in the next 40 mm area, it suddenly decreased, and then from that area to the side wall it was not detected at all.

The following was found from the results mentioned above. FIG. 5 shows that the carbon in the powdered coke was completely gasified even when the m value was less than 1.0 through the steps as follows; the carbon is first oxidized to $CO_2$ through Equation 6, and then according to Equation 7, it becomes CO, completing gasification. However, the reaction rate of Equation 7 is much slower than the reaction rate of Equation 6, showing that the rate determinate step is the reaction of Equation 7, which is backed by conventional theory. Also, FIG. 7 shows that the concentration of $CO_2$ decreases while the concentration of CO increases along the distance from the center toward the side wall of the reaction tower. From this result, and from the result that there was no unburned powdered coke detected near the side wall of the reaction tower, it shows that all of the unburned powdered coke stirred up by the recirculation flow reacts as shown in Equation 7, and all of the unburned powdered coke that is not stirred up moves into the furnace as is, most part of which, although part of which becomes CO according to Equation 7, is exhausted into the condenser.

Therefore, in order to further increase the gasification rate, it is necessary to use the gasification burner of the second embodiment of this invention, and to keep the relationship between the powdered solid fuel and the oxygen-bearing gas supplied to the pre-mixing pipe to increase the m value as high as possible, and to regulate the entire balance using the sub-mixing pipes. Also, as can be seen in FIG. 5, it is desirable that the relationship between the powdered solid fuel and the oxygen-bearing gas supplied to the pre-mixing pipe should be kept so as to provide the m value between 0.9 and 1.

A specified example of this method is explained in detail below, by feeding 82% C powdered coke into the pre-mixing pipe using air, and using 90% purity industrial oxygen to form an oxygen-bearing gas having an oxygen concentration of 75% to obtain a gas of $CO_2$:CO ratio of 0.5 ($CO_2/CO=0.5$).

In order to obtain with a 100% gasification rate a gas of $CO_2$:CO ratio of 0.5 ($CO_2/CO=0.5$), 102 $Nm^3$ of oxygen is needed for 100 kg of powdered coke. Also, in order to have complete combustion and have the entire amount of carbon form $CO_2$, 153 $Nm^3$ of oxygen is required. Therefore, in this case the m value becomes 102 $Nm^3$/153 $Nm^3$=0.67.

The oxygen balance is given by Equation 12 below.

$$0.21\ Vair + 0.9\ VO2 = 102 \qquad \text{Eq. 12}$$

Here, Vair is the volume of air for carrier, and VO2 is the volume of industrial oxygen for enrichment.

Also the oxygen concentration is given by Equation 13 below.

$$102/(Vair + VO2) = 0.75 \qquad \text{Eq. 13}$$

By solving Equations 12 and 13, the values Vair=30 $Nm^3$, and VO2=106 $Nm^3$ are obtained. Since the amount of powder carried by the air is limited to at most about 10 kg per kg of gas, there is no problem in this example with using 2.6 kg of powder per kg of gas (100 kg /30 $Nm^3 \times 22.4$ $Nm^3$ per mole/28.8 kg per mole=2.6 kg powder/kg gas).

An example of distribution among the pre-mixing pipe and sub-mixing pipes using the above results is shown below.

TABLE 1

| | Pre-mixing Pipe | Sub-mixing Pipes | Total |
|---|---|---|---|
| Fine coke | 80 kg/h | 20 kg/h | 100 kg/h |
| Air | 24 $Nm^3$ | 6 $Nm^3$ | 30 $Nm^3$ |
| Industrial Oxygen | 95 $Nm^3$ | 11 $Nm^3$ | 106 $Nm^3$ |
| m Value | 0.74 | 0.37 | 0.67 |

In table 1, a distributor is used to distribute the air flow including the powdered coke, at a ratio of 8:2, to the pre-mixing pipe and sub-mixing pipes, while 90% of the industrial oxygen is blown into the pre-mixing pipe and the remainder of the industrial oxygen is blown into the sub-mixing pipes.

TABLE 2

| | Pre-mixing Pipe | Sub-mixing Pipes | Total |
|---|---|---|---|
| Fine coke | 67 kg/h | 33 kg/h | 100 kg/h |
| Air | 20.1 $Nm^3$ | 9.9 $Nm^3$ | 30 $Nm^3$ |
| Industrial Oxygen | 106 $Nm^3$ | 0 $Nm^3$ | 106 $Nm^3$ |
| m Value | 0.97 | 0.04 | 0.67 |

In table 2, a distributor is used to distribute an air flow including the fine coke, at a ratio equal to the m value, to the pre-mixing pipe, while all of the industrial oxygen is blown into the pre-mixing pipe. Although a substantial amount of oxygen-enriched air must be used, because the m value in the pre-mixing pipe is greater than 0.95, it is expected that a high gasification rate can be obtained.

Also, the supply to the sub-mixing pipes does not depend on the air flow with fine coke, and can be performed by dropping the fine coke using a rotary valve, and so in this case it is possible to supply the entire amount of air for carrier to the pre-mixing pipe.

EXAMPLE 1

82% carbon grade fine coke is used, and in order to obtain a reduction gas having a $CO_2$:CO ratio of 0.5 ($CO_2$/CO=0.5), the gasification burner of this invention is formed based on the conditions shown in Table 3.

TABLE 3

| | |
|---|---|
| Fine coke | 200 kg/h |
| Oxygen-bearing gas | Oxygen rich air 270 $Nm^3$/h (oxygen concentration 76%) |
| Breakdown | Feed air 55 $Nm^3$/h<br>90% pure industrial oxygen 215 $Nm^3$/h |
| Gas velocity in the pre-mixing pipe | 10 m/sec |
| Estimated temperature in combustion chamber | 2473 K. |
| Residence time in combustion chamber | 150 ms |
| A | 70 mm |

According to the above conditions, d is 100 mm. Using this value and with A=70 mm, from Equation 9 and Equation 11, D becomes 500 mm and L becomes 600 mm. Using these values for d, D, and L, angle $\alpha$ becomes 18.4 degrees, using Equation 8. Next, using these values and with 1=100 mm, the gasification burner is made as shown in FIG. 3, and arranged on top of the furnace reaction shaft as shown in FIG. 6, and operation was tested for 3 days using the design conditions mentioned above. During that time, exhaust gas is sampled through the measurement hole (not shown in the figure) of the uptake 66, and the $CO_2$, CO and $O_2$ concentrations were analyzed using the Orsat method. After examining the obtained values, it was found that there was very little change over the three day period, and the average values were $CO_2$=39.5%, CO=41.5%, and $O_2$=0%. Also the resuits of a mass balance test showed that 90% carbon of the fine coke was gasified. However, the $CO_2$:CO ratio did not become 0.5.

When the inside surface of the combustion chamber was examined after the test was finished, the ash constituents of the fine coke were melted and had uniformly covered the entire inner surface with a slag layer having a thickness of approximately 20 mm; However there was no visible wear or abrasion caused by the impact of the fine coke.

EXAMPLE 2

In this example, the amount of industrial oxygen used was 192 $Nm^3$/h, and the same gasification burner as Example 1 was used. Operation was tested for 3 days. The average concentration values over the three days of $CO_2$, CO, and $O_2$ in the exhaust gas were found to be, $CO_2$=27.5%, CO=54.0%, $O_2$=0%. Also, the mass balance results gave a gasification rate of 90%. Therefore, in this example, it was possible to achieve a $CO_2$:CO ratio of 0.5 with a gasification rate of 90%.

EXAMPLE 3

In this example, two sub-mixing pipes with internal diameters of 25 mm were located on the combustion chamber ceiling of the gasification burner of Example 1, so that they were parallel with the pre-mixing pipe as can be seen in FIG. 3. The operation was tested for 3 days using the same conditions as Example 1. In this example, $\frac{2}{3}$ of the total amount of mixture of fine coke and feed air was supplied to the pre-mixing pipe, and the remaining $\frac{1}{3}$ was equally divided and supplied to both of the sub-mixing pipes. Also, the m values of the pre-mixing pipe and both of the sub-mixing pipes was made to be 0.67. The average concentration values over the three days of $CO_2$, CO, and $O_2$ in the exhaust gas were found to be, $CO_2$=35.0%, CO=47.0%, $O_2$=0%, and the gasification rate found from the mass balance was 94%.

EXAMPLE 4

In this example, except that the blow direction of the sub-mixing pipes was pointed toward the center axis of the pre-mixing pipe as shown in FIG. 4, the operation was tested for 3 days in the same manner as for example 3. The average concentration values over the three days of $CO_2$, CO, and $O_2$ in the exhaust gas were found to be, $CO_2$=37.0%, CO=44.0%, $O_2$=0%, and the gasification rate found from the mass balance was 92%.

EXAMPLE 5

In this example, except that the entire amount of industrial oxygen was supplied to the pre-mixing pipe, operation was tested for 3 days in the same manner as in Example 3. The m value of the pre-mixing pipe was made to be 0.99 and the m values of both the sub-mixing pipes were made to be 0.03. The average concentration values over the three days of $CO_2$, CO, and $O_2$ in the exhaust gas were found to be, $CO_2$=32.5%, CO=49.5%, $O_2$=0%, and the gasification rate found from the mass balance was 96%.

Comparison Example

Except that 100 $Nm^3/h$ of the industrial oxygen was supplied to the pre-mixing pipe and the remaining of the industrial oxygen was supplied to the sub-mixing pipes, the operation was tested for 3 days in the same manner as Example 3. The m value for the pre-mixing pipe was 0.479 and the m values for the sub-mixing pipes were 1.05. The average concentration values over the three days of $CO_2$, CO, and $O_2$ in the exhaust gas were found to be, $CO_2$=46.0%, CO=34.0%, $O_2$=0%, and the gasification rate found from the mass balance was 85%.

By using the gasification burner of this invention, it is possible to avoid contact between the powdered solid fuel and the side walls of the combustion chamber, and it is possible to lengthen the retention time the powdered solid fuel in the combustion chamber by creating a recirculation flow in the combustion chamber and efficiently utilizing this recirculation flow. Also it is possible to obtain a stable high gasification rate for a long period of time. By using the method featured by this invention, it is possible to even further take advantage of the gasification burner of this invention.

Although the pre-mixing pipe has its lower end aligned with the lower surface of the ceiling in the embodiment mentioned above, the pre-mixing pipe may project from the lower surface of the ceiling so long as the recirculation flows are produced about the conical injection flow.

What is claimed is:

1. A method for using a gasification burner for powdered solid fuel, in which the burner comprises:

a combustion chamber having a ceiling formed with an opening therethrough, said chamber having a vertical center axis and said ceiling having a lower surface defining the top of the combustion chamber;

a pre-mixing pipe for conveying under pressure to said combustion chamber a combustible mixture of powdered solid fuel and an oxygen-bearing gas, said pipe having a center axis and a lower end connected to said opening in said ceiling and defining with the lower surface of said ceiling a horizontal plane substantially at right angles to the center axis of said pre-mixing pipe, a nozzle connected to said pre-mixing pipe near the upper end thereof for supplying said oxygen-bearing gas to said pipe for mixing therein with said powdered solid fuel, said nozzle having a center axis, said pre-mixing pipe and said combustion chamber being concentric;

a plurality of sub-mixing pipes mounted in said ceiling and directed into said combustion chamber, said sub-mixing pipes being mounted between the pre-mixing pipe and the side wall of the combustion chamber and being spaced from each other to form a concentric circle with the pre-mixing pipe, powdered solid fuel and an oxygen-bearing gas being supplied under pressure to said sub-mixing pipes for delivery to said combustion chamber to enhance combustion;

wherein the powered solid fuel and oxygen-bearing gas mix in said pre-mixing pipe and emanate from the lower end of said pre-mixing pipe into said combustion chamber in the form of a cone-shaped gas flow increasing in diameter away from said lower end of said pre-mixing pipe, the total spread angle of the conical surface of the combustible gas flow forming an angle $2\alpha$, and wherein $\alpha$ is between 5° and 20°, and the variable values are determined by the following equation:

$$\tan\alpha=(D-d)/2/L,$$

wherein

D is the internal diameter in mm of the combustion chamber d is the internal diameter in mm of the pre-mixing pipe L is the length or height of the combustion chamber l is the distance in mm from the center axis of the nozzle to the lower end of the pre-mixing pipe, and 5d is equal to or less than 1, including the step of making the oxygen ratio m for the pre-mixing pipe greater than the oxygen ratio m for the sub-mixing pipe, wherein m is obtained from the equation m=amount of oxygen actually supplied/amount of oxygen required to oxidize all of the C and H in the fuel to obtain $Co_2$ and $H_2O$.

2. A method for using a gasification burner as in claim 1, wherein the oxygen ratio m of the pre-mixing pipe is between 0.9 and 1.0, and is greater than the oxygen ratios m for the sub-mixing pipes.

3. A method of using a gasification burner as in claim 1, wherein a majority of oxygen-bearing gas is supplied to the pre-mixing pipe, wherein the quantity of powdered solid fuel supplied to the pre-mixing pipe is such that the oxygen ratio m is 0.9 to 1.0 and greater than the oxygen ratios m for the sub-mixing pipes, and wherein the remaining oxygen-bearing gas and powdered solid fuel is supplied to the sub-mixing pipes.

4. A gasification burner for powdered solid fuel, comprising:

a cylindrical combustion chamber disposed upright having a sidewall and a ceiling formed with an opening therethrough, said chamber having a vertical center axis and said ceiling having a lower surface defining the top of the combustion chamber;

a cylindrical pre-mixing pipe for conveying under pressure to said combustion chamber a combustible mixture of powdered solid fuel and an oxygen-bearing gas, said pipe having a center axis and a lower end connected to said opening in said ceiling, said lower end of said pre-mixing pipe being unobstructed for directing said combustible mixture unimpeded to said combustion chamber, and a nozzle connected to pre-mixing pipe near the upper end thereof for supplying said oxygen-bearing gas to said pipe for mixing therein with said powdered solid fuel, said nozzle having a center axis, wherein the powdered solid fuel and oxygen-bearing gas mix in said pre-mixing pipe and emanate from the lower end of said pre-mixing pipe into said combustion chamber in the form of a cone-shaped gas flow increasing in diameter away from said lower end of said pre-mixing mixture pipe, the spread angle of the conical surface of the combustible forming an angle $2\alpha$, and wherein $\alpha$ is between 5° and 20°, and the variable values are determined by the equation:

$$\tan \alpha = (D-d)/2/L,$$

wherein D is the internal diameter in mm of the combustion chamber d is the internal diameter in mm of the pre-mixing pipe L is the length or height of the combustion chamber l is the distance in mm from the center axis of the nozzle to the lower end of the pre-mixing pipe, and 5*d* is equal to or less than 1, whereby spaces in the combustion chamber around the conical surface of the combustible mixture are more effectively utilized for combustion reaction thereby maintaining a high combustion rate for a longer period of time.

5. The gasification burner for powdered solid fuel according to claim 4 wherein the distance between the conical surface of the gas flow and the side wall the combustion chamber at the bottom of such chamber is between 0 and 100 mm and is determined by the following equation $$\tan 12 \text{ degrees} = \{(D-d)/2-A\}/L$$

wherein D, d and L are as previously defined in claim 4.

6. The gasification burner for powdered solid fuel as in claim 4, further including at least one sub-mixing pipe mounted on the ceiling of the combustion chamber and directed into said chamber.

7. The gasification burner for powdered solid fuel as in claim 6, further including a plurality of sub-mixing pipes equally spaced around the pre-mixing pipe and mounted on the ceiling of the combustion chamber between the pre-mixing pipe and the side wall of the combustion chamber, said sub-mixing pipes being directed downwardly into said chamber and forming a concentric circle with the pre-mixing pipe.

8. The gasification burner for powdered solid fuel as in claim 7, wherein the oxygen ratio m for the pre-mixing pipe is greater than the oxygen ratios m for the sub-mixing pipes, wherein the value of m is obtained from the following equation:

m = Amount of oxygen actually supplied)/Amount of oxygen required to oxidize all of the C and H in the fuel to obtain $CO_2$ and $H_2O$.

* * * * *